US005512345A

United States Patent [19]

Tsutsumi et al.

[11] Patent Number: 5,512,345

[45] Date of Patent: Apr. 30, 1996

[54] VACUUM INSULATOR CASING AND METHOD OF MAKING VACUUM INSULATOR PANEL

[75] Inventors: Masato Tsutsumi; Haruhisa Yamasita; Hideo Sampei; Kanako Fujii; Hiroaki Asakura, all of Osaka, Japan

[73] Assignee: Kabushiki Kaisha Toshiba, Kanagawa, Japan

[21] Appl. No.: 411,876

[22] Filed: Mar. 28, 1995

[30] Foreign Application Priority Data

Mar. 28, 1994 [JP] Japan ..... 6-057374

[51] Int. Cl.[6] ..... B32B 1/04

[52] U.S. Cl. ..... 428/69; 428/60; 52/404.1; 62/DIG. 13; 220/421

[58] Field of Search ..... 428/60, 69; 312/406; 52/404.4, 404.1; 220/421; 62/DIG. 13

[56] References Cited

U.S. PATENT DOCUMENTS 2,768,046 10/1956 Evans ..... 312/406

*Primary Examiner*—Alexander S. Thomas

*Attorney, Agent, or Firm*—Cushman Darby & Cushman

[57] ABSTRACT

A vacuum insulator casing for thermal insulating between inside and outside of the casing. The vacuum insulator casing has an inner casing constructed at least two planer sections and a corner section located between the planer sections and an outer casing having a similar shape to the inner casing, which covers the inner casing having a space between them. The space the inner and outer casings is filled with a plurality of vacuum insulator panels and other insulator material. Each vacuum insulator panel has a gas tight outer package from which air has been evacuated and a low thermal conductivity material filled in the package. The vacuum insulator panels are sandwiched between the inner and outer casings so as to touch both casings.

12 Claims, 11 Drawing Sheets

Fig. 6
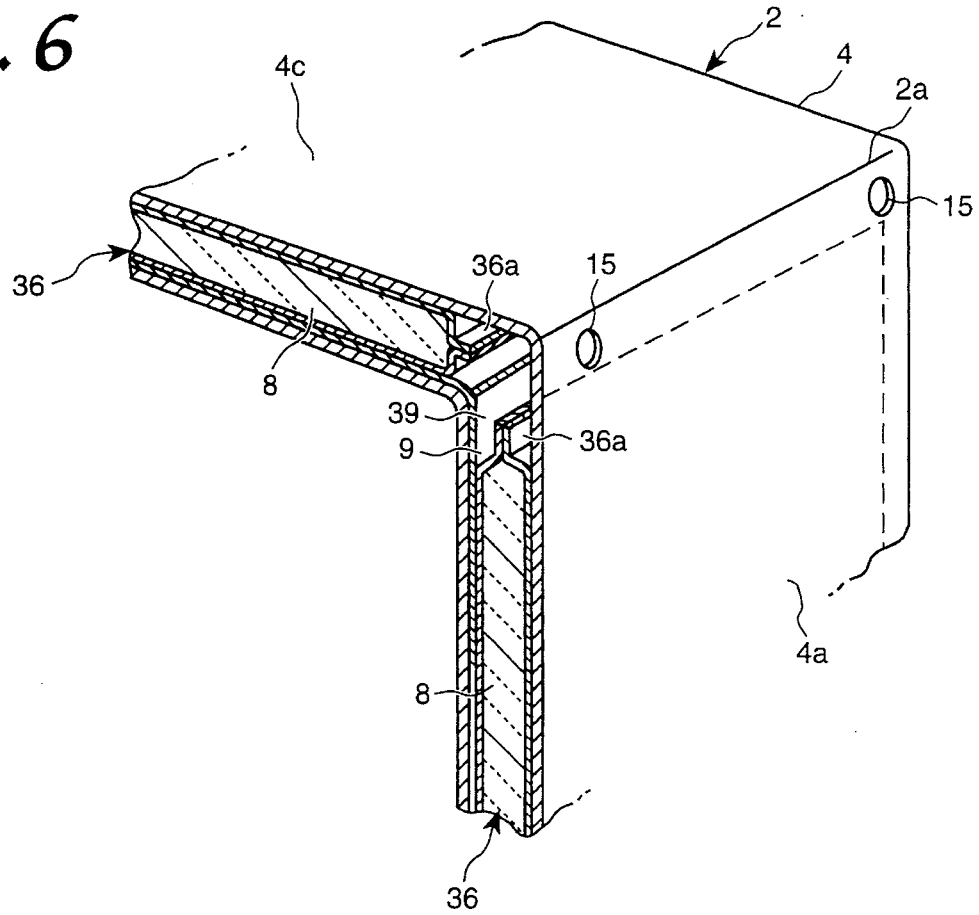
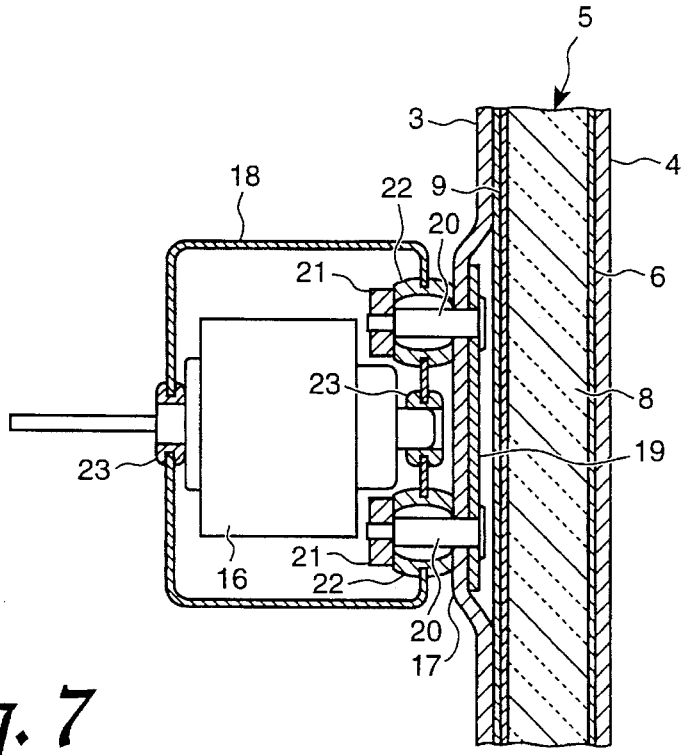
Fig. 7

Fig. 17
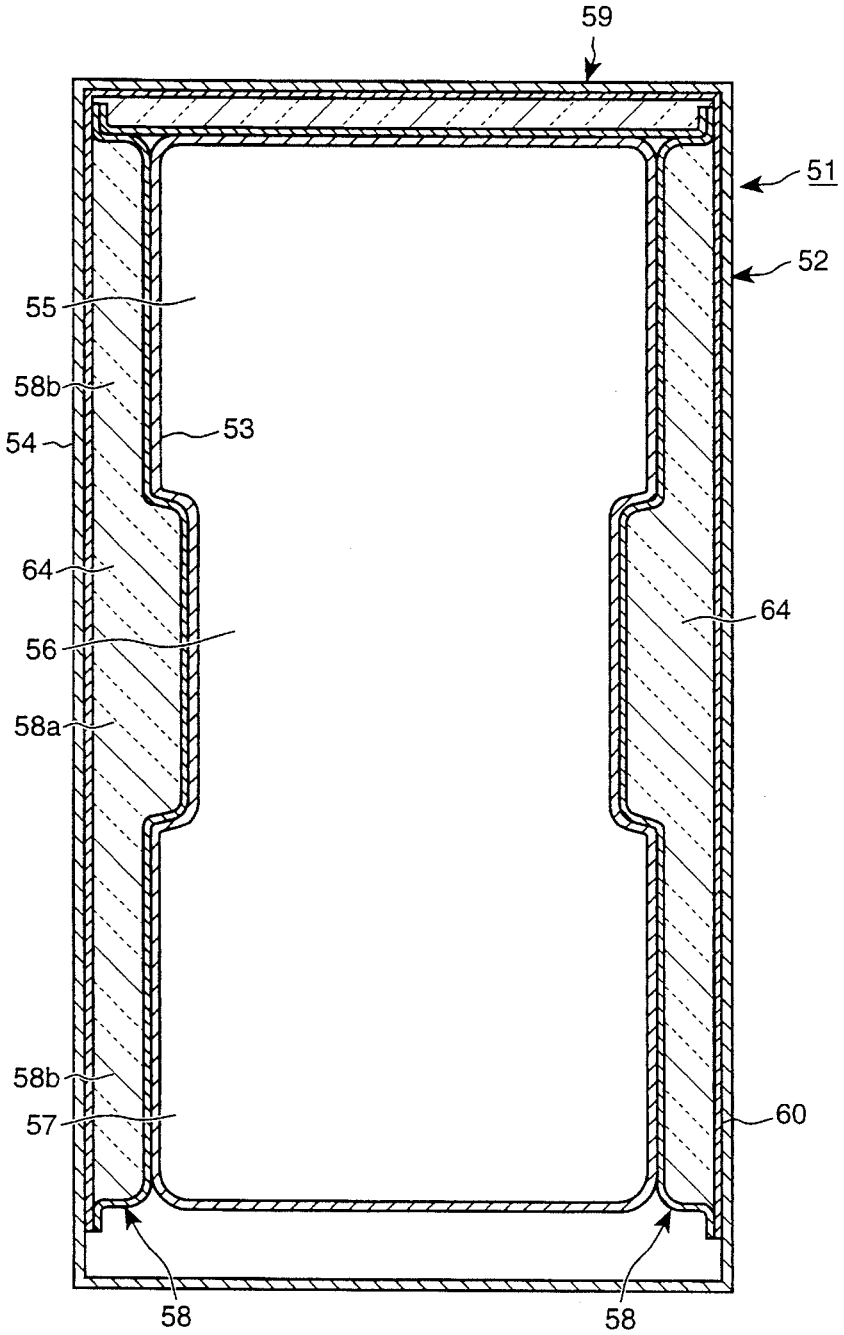
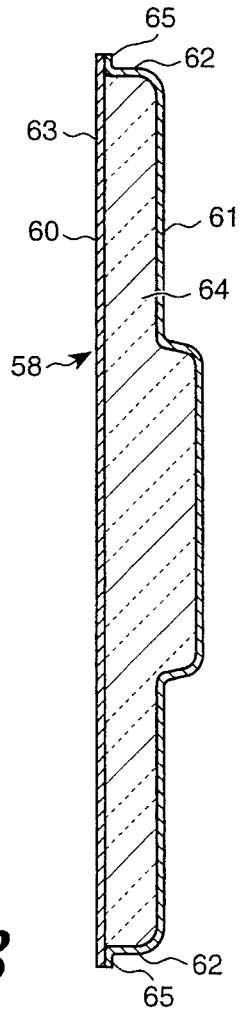
Fig. 18

VACUUM INSULATOR CASING AND METHOD OF MAKING VACUUM INSULATOR PANEL

BACKGROUND OF THE INVENTION

1. Field of the Invention

The present invention relates to vacuum insulator panels, constructions using vacuum insulator panels, and their manufacture.

2. Description of Related Art

Thermal insulator casings are used in the construction of various types of devices and systems, such as refrigerators, freezers, show-cases, etc. The most widely used thermal insulation material is polyurethane foam. A conventional thermal insulator casing has a metal outer casing, a plastic inner casing and polyurethane foam between the outer and inner casings. Polyurethane foam is a reasonably good insulator. However, even better insulation can be achieved using a vacuum insulator panels instead of polyurethane foam between the outer and inner casings.

A vacuum insulator casing comprising a vacuum insulator panel is disclosed in U.S. Pat. No. 4,681,788. The vacuum insulator panel is formed by a thin plate. The panel is wrapped by a sealed shell which includes a multilayer film having thin metal foil laminas to prevent gas leakage. $_{13}$An inner space defined by the shell is filled with mixture of precipitated silica and fly ash as a filer. Air in the shell is evacuated to create a vacuum inside the shell. Then, the film is air tightly sealed by any suitable means, e.g., hot melting or adhesive bonding. These vacuum insulator panels are fixed at an outer casing or an inner casing. Any additional space between the outer casing or the inner casing and the vacuum insulator panels is filled with foamed in place polyurethane foam. A vacuum insulator casing of this type provides a better thermal insulating performance than can be achieved using a conventional polyurethane foam insulator casing of comparable thickness. However, at the polyurethane foam portion between the inner casing and the outer casing, the thermal insulating performance is the same as that of a conventional insulator casing.

An alternative embodiment of a vacuum insulation casing is also shown in U.S. Pat. No. 4,681,788. A vacuum insulator panel is sandwiched between outer and inner casings. This vacuum insulator casing has a high degree of thermal insulation. However, when vacuum insulator panels are used to construct a refrigerator or the like, it is necessary to make corner sections to fit the space between the outer and inner casings. Corner sections of a vacuum insulator panels must be harder than straight sections because of the additional forces at corner sections. A hard vacuum insulator panel can be made by using a high density filler in the shell. However, using a high density of filler decreases the space available for vacuum. Thus, using a high density of filler decreases the thermal insulating performance of the panel. Another way to achieve the needed strength is to use a harder shell. However, if a harder shell is used, the shell and the vacuum insulator panel becomes thick. A thick shell usually has a high thermal conductivity, so its thermal insulating performance is decreased. Therefore, it is difficult to fill up all of the space in the insulator casing, i.e. the space between the outer casing and the inner casing, using vacuum insulator panels.

Another problem associated with the use of convention vacuum insulator panels has to do with their disposal. Proper disposing of a vacuum insulator casing requires that it first be analyzed to determine its constituent parts. In conventional vacuum casings, a vacuum insulator panel is firmly fixed with the outer or inner casing, or buried within polyurethane foam in order to improve it's thermal insulating performance. Therefore, it is difficult to analyze.

Another known vacuum insulator panel uses hard polyurethane foam having a continuous foam as a filler instead of using a mixture of precipitated silica and fly ash. The continuous foam is made by mixing foamed in place material with foam breaker when it is foaming. However, the surface of hard polyurethane foam tends to remain as a individual foams. It is impossible to evacuate the air from the individual foams. Thus, the individual foams on the surface of the hard polyurethane reduce the thermal insulating performance of the vacuum insulator panel.

SUMMARY OF THE INVENTION

It is an object of the invention to provide an improved vacuum insulator casing.

It is another object of the invention to provide a improved vacuum insulator panel which is easy to analyze and position in its proper place.

It is further object of the invention to provide a method of making a improved vacuum insulator panel, which uses foaming material as a filler, achieving high thermal insulating performance.

It is further object of the invention to provide a vacuum insulator casing which is easy to analyze to determine each material used in its fabrication.

To achieve these objects, this invention provides an improved vacuum insulator casing providing good thermal insulation between its inside and outside. The vacuum insulator casing has an inner casing having at least two plain sections and a corner section located between the plain sections, an outer casing having a similar shape to the inner casing, which covers the inner casing so as to define a space between the outer casing and the inner casing, and a plurality of vacuum insulator panels. Each vacuum insulator panel has a gas tight outer package from which air has been evacuated, which has one side and the other side, and a low thermal conductivity material filled in the package. Each vacuum insulator panel is sandwiched between the outer casing and the inner casing so that one side of each panel touches one of the casings and the other side of each panel touches the other casing. Insulation material fills up any remaining space between the outer and inner casings.

There is further provided a method for making a vacuum insulator panel. A continuous foam filler is formed by injection a forming liquid and a foam breaker into a forming jig. Then, the surface of the filler is shaved off. After that the filler is placed in an outer package that is gas tight. The outer package, including the filler therein, is evacuated and sealed.

BRIEF DESCRIPTION OF THE DRAWINGS

In the accompanying drawings;

FIG. 6 is a cross-sectional perspective view of another configuration of a corner joint of the refrigerator;

FIG. 7 is an enlarged cross-sectional view at a fan portion of the refrigerator shown in FIG. 1;

FIG. 17 is a front cross-sectional view of a refrigerator casing according to third embodiment of the present invention;

FIG. 18 is a cross-sectional view of a vacuum insulator panel used in the refrigerator casing shown in FIG. 17;

DETAILED DESCRIPTION OF PREFERRED EMBODIMENTS

Figure 1:
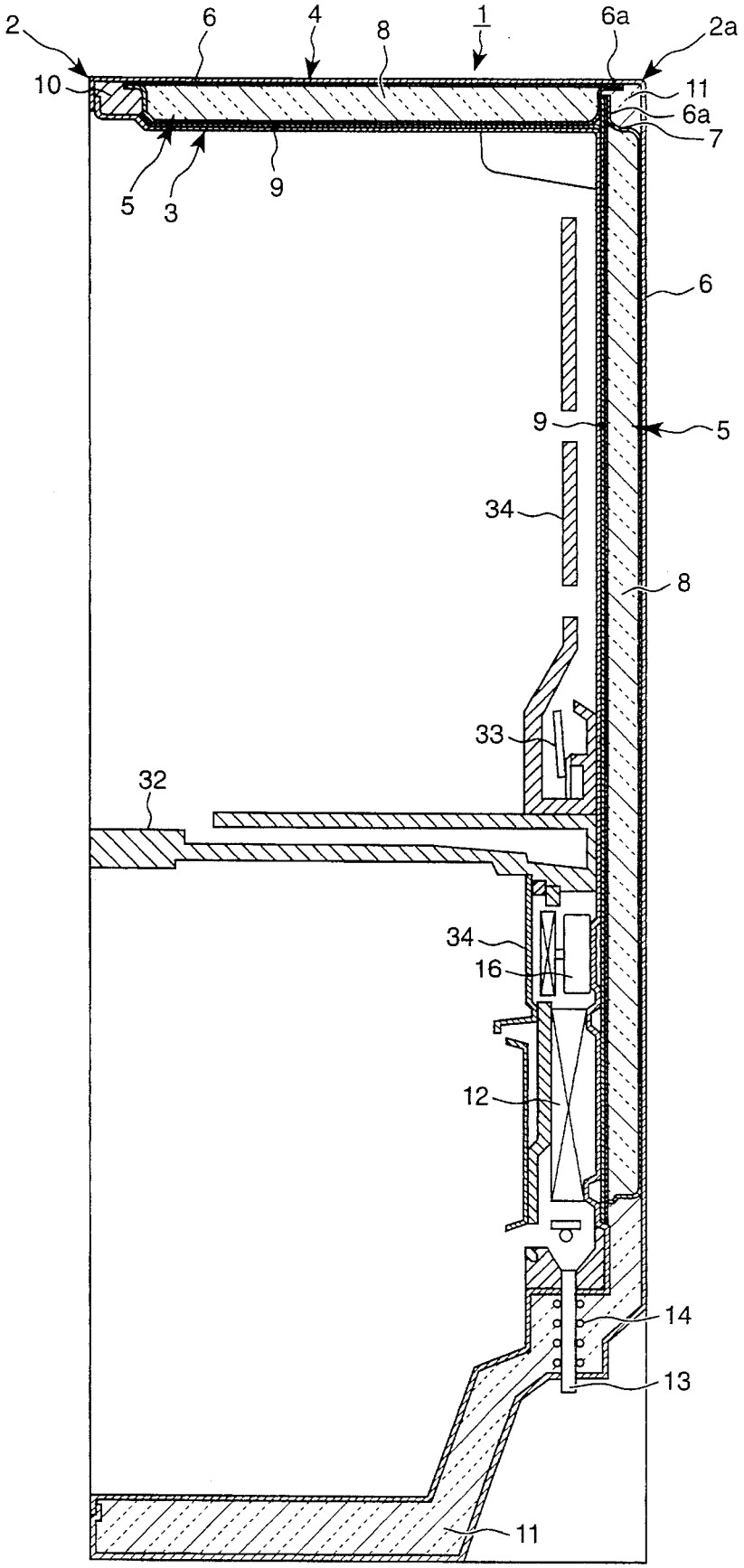
FIG. 1 is a cross-sectional view of a refrigerator using a vacuum insulator casing according to the present invention.

An embodiment of the present invention will be explained with reference to FIGS. 1–10. A vacuum insulator casing is used to form a refrigerator 1 as shown in FIG. 1. Of course, even though a refrigerator is shown for illustrative purposes, the invention is not limited to refrigerators. The insulator arrangements according to the present invention can be used to form various kinds of devices requiring thermal insulation. For example, the insulator casings of the present invention could be used to form freezers, show-cases, air ducts of an air conditioner, etc.

An outer shell 2 of refrigerator 1 is constructed by an inner casing 3 made of plastics and an outer casing 4 made of thin steel. Each portion of the refrigerator, i.e. plane sections, roof, back and sides, has a vacuum insulator panel 5 sandwiched between outer casing 4 and inner casing 3. Each vacuum insulator panel may have a different size even though they are all of the same general configuration. A cooling coil 12 for cooling the air in compartments of refrigerator 1 is fixed to inner casing 3. A fan motor 16 to drive a fan 16*a* for circulating the air in the compartments is also fixed to inner casing 3. A damper 33 controls a flow direction of cooled air passing through cooling coil 12. Covers 34 form an air duct for cooled air to pass through to inner casing 3. A middle partition 32 divides the inner space of refrigerator 1 into two compartments.

Figure 3:
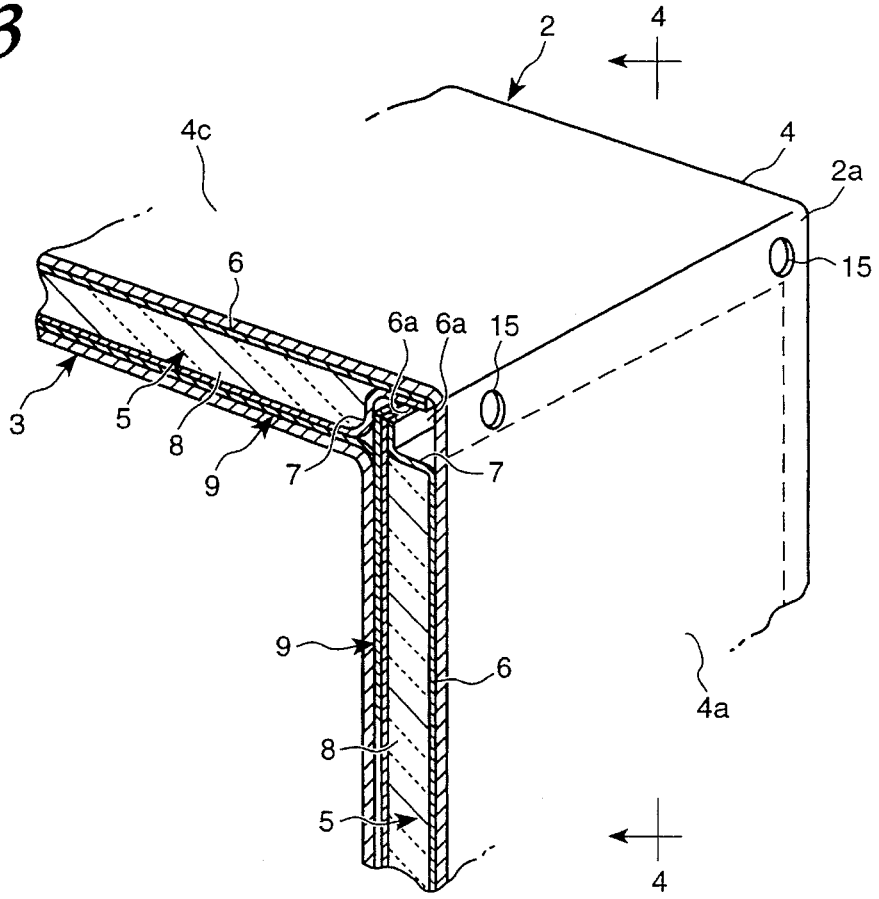
FIG. 3 is a cross-sectional perspective view of an upper back side corner joint which joins adjacent vacuum insulator panels of the refrigerator.

Vacuum insulator panel 5 has a gas tight package 6 which has an inner space. A filling 8, which is a thermal insulation material, for example small powdered pearlite or silica, and wrapped by air passing through envelope (not shown), is contained within the inner space of package 6. Air in the package is evacuated through an opening of package 6, then the opening is fastened by hot pressing, etc. Thus the inner space of package 6 is maintained at a vacuum. Package 6 is formed with rectangular plate having borders 6*a*. Border 6*a* is stretched outwardly from one side of end portion 7 of package 6 and formed into the plane of one side of the package 6 as shown in FIG. 3.

Each vacuum insulator panel 5 is adhesively fixed at the inside of outer casing 4 using a hot melt material such as thermal plastics and is attached to the inside of inner casing 3 through a soft sheet 9, that is less than 5 mm thick and which is preattached to inner casing 3. The front of upper roof and each front end of outer shell 2 is filled with formed polyurethane foam 10. However, other suitable low thermal insulator materials could be used, for example, glass wool, instead of the formed polyurethane foams 10. Remaining space in outer shell 2, not taken up by vacuum insulator panels 5 and formed polyurethane foam 10, is filled with a foamed in place insulator material 11, such as foamed in place polyurethane foam. The bottom of outer shell 2 is also filled with foamed in place insulator material 11 because of it's complex shape.

Drain pipe 13 which drains water dropped from a cooling coil 12 during refrigerator, drain pipe heater 14 which prevents drainpipe 13 from icing and a refrigerating circuit pipe (not shown in FIG. 1) are fixed to inner casing 3 or outer casing 4 before the foaming in place insulator material 11 is formed.

Figure 2:
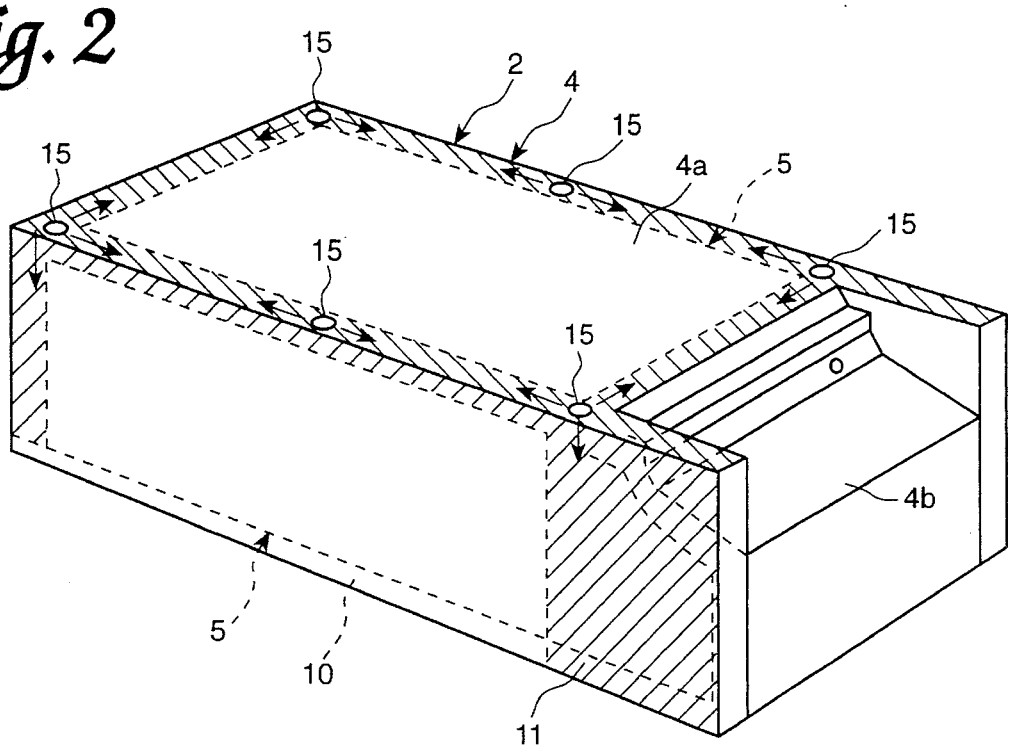
FIG. 2 is a perspective view from the rear of the refrigerator shown in FIG. 1.

Injection ports 15 are provided for injecting a liquid of the foamed in place material are arranged at a corner section of back board 4*a* of outer casing 4 as shown in FIG. 2. Each injection port 15 is opened at a space between adjacent vacuum insulator panels 5. Two injection ports 15 are provided at each of the upper back board, the bottom back board and the middle back board. So, there are six injection ports in all. Injection ports 15 at the bottom back board can be formed in bottom 4*b* of outer casing 4 as well.

If the foamed in place material is polyurethane foam, a mixture of isocyanide and polyol, is injected. Liquid flows into any remaining space not occupied by vacuum insulator panels 5 and formed polyurethane foams 10, and foam and coagulate in outer shell 2. Consequently, The space in outer shell 2 except for the space occupied by vacuum insulator panels 5 and formed polyurethane foams 10 is filled with foamed in place insulator material 11. Therefore, vacuum insulator panels 5 and formed polyurethane foams 10 are rigidly fixed at the inside of outer shell 4 by foaming in place insulator material 11. Especially the corner section of outer shell 2 is filled up with foaming in place material 11, so the corner section is stronger than the plane section of casing in which there is only vacuum insulator panel, without any other insulating materials, sandwiched between outer casing 4 and inner casing 3. At injection, the liquid of the foamed in place material does not penetrate into the space between vacuum insulator panel 5 and outer casing 4 or inner casing 3, because the vacuum insulator panels are adhesively fixed to the inside of outer casing 4 with a hot melt and attached to inner casing 3 through soft sheet 9. Therefore, looking at a cross section of a plane section of casing, one would see the following layers of material in order from inside to outside of the casing: inner casing 3, soft sheet 9, package 6, filler 8, package 6, hot melt material, and outer casing 4.

Figure 4:
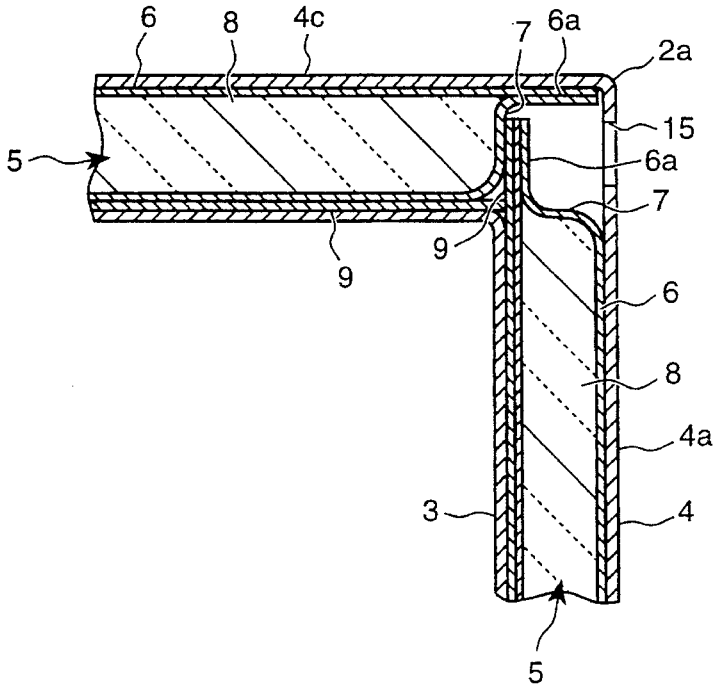
FIG. 4 is a cross-sectional view of the corner joint taken along the 4—4 line of FIG. 3.

A corner section of adjacent vacuum insulators 5 is shown in FIGS. 3 and 4. Border 6*a* of vacuum insulator panel 5 located in the upper roof is attached at the inside of upper roof section 4*c* of outer casing 4. Boarder 6*a* of a side vacuum insulator panel 5 located in the back board is attached at the inside of inner casing 3, and extends upwardly from inner casing 3 and attached at end portion 7 of a vacuum insulator panel 5 located in the upper roof. Namely, border 6*a* of a vacuum insulator panel 5 located in the back board overlaps with end portion 7 of a vacuum insulator panel 5 located in the upper roof. In this arrangement, the injection of foaming in place insulating material through injection port 15 flows smoothly into the space of a corner section with no obstruction. Therefore the space of corner section fills with foamed in place insulator material, and the insulating performance and strength at the corner section is improved. Furthermore, the space filled with foamed in place insulator material 11 can be minimized because adjacent vacuum insulator panels 5 are near each other. In corners between each side board and the upper roof, adjacent vacuum insulator panels 5 are arranged in the same manner as described above.

Figure 5:
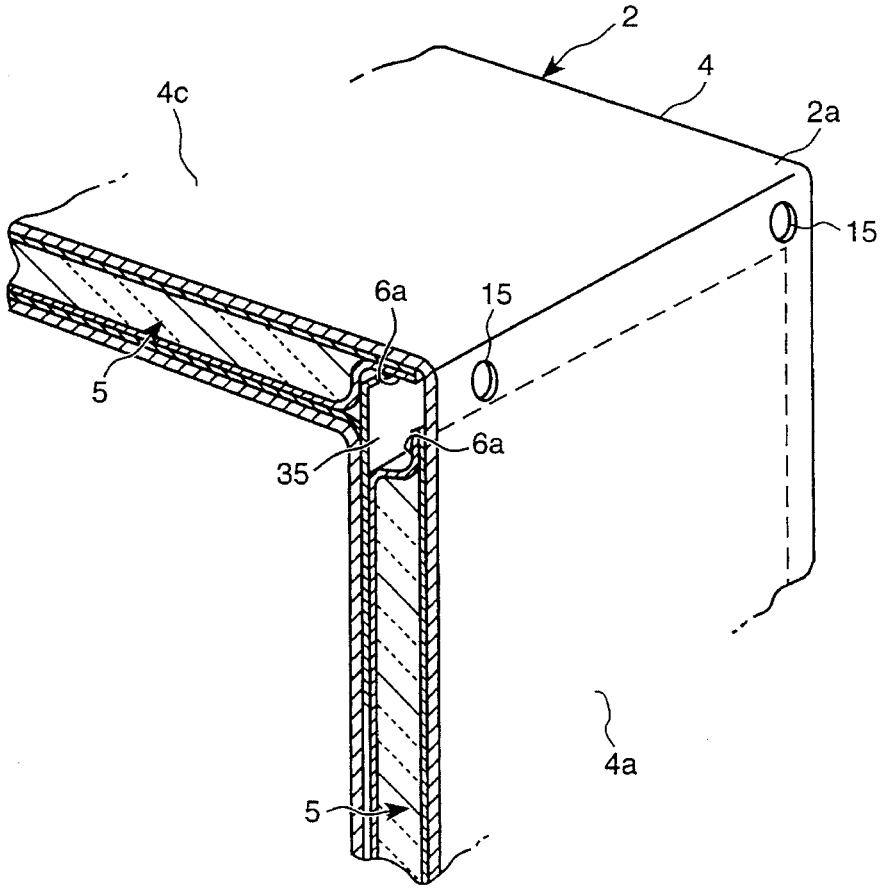
FIG. 5 is a cross-sectional perspective view of another configuration of a corner joint of the refrigerator.

However, the borders 6*a* of adjacent vacuum insulator panels 5 can be attached at outer casing 4 as shown in FIG. 5. In this configuration, the end of a border 6*a* is arranged under injection port 15 in order to form a space to inject a foamed in place insulator material 11. Furthermore, as shown in FIG. 6, it is possible to use a vacuum insulator panel 36 having a border 36*a* located at the center of an end portion of vacuum insulator panel 36. In this case, the end of border 36*a* of vacuum insulator panel 36 is also arranged under injection port 15. The space 35 shown in FIG. 5 and the space 39 shown in FIG. 6 which are filled up with foamed in place insulator material are slightly larger than as shown in FIG. 4. Although, in the configurations shown in FIGS. 5 and 6, adjacent vacuum insulator panels 5, 5 and 36, 36 are arranged without overlapping each other. Therefore, it is easy to arrange and attach all vacuum insulator panels 5 and 36 to outer casing 4.

Figure 8:
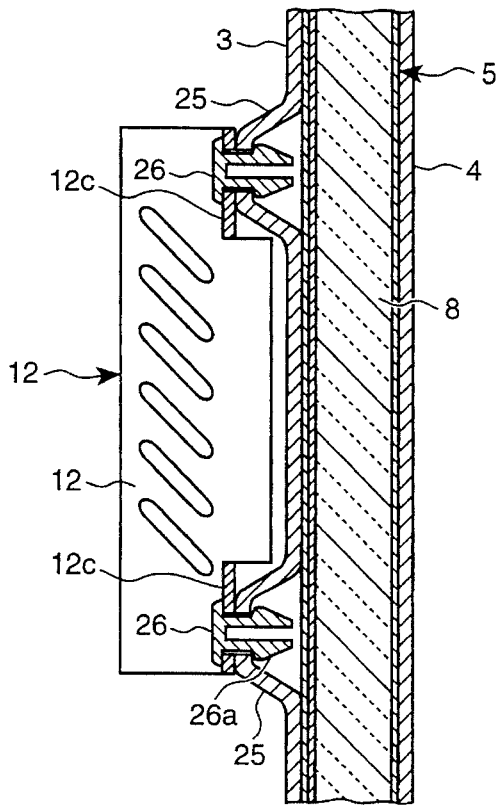
FIG. 8 is an enlarged cross-sectional view at a cooling coil portion of the refrigerator shown in FIG. 1.
Figure 9:
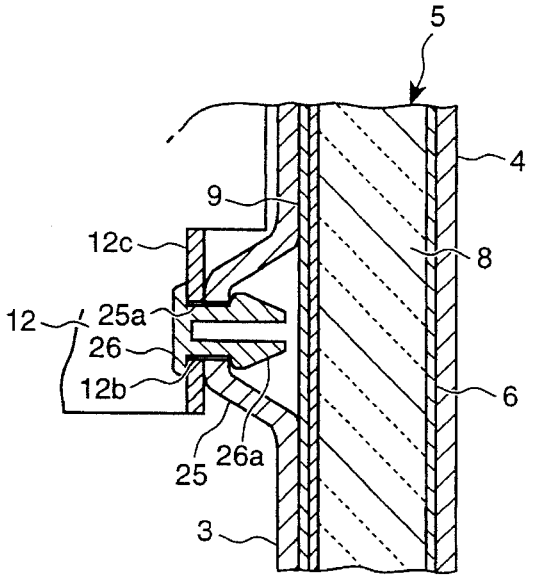
FIG. 9 is a further enlarged cross-sectional view of a cooling coil fixing portion in FIG. 8.

Referring now to FIG. 7, there is shown a portion of the refrigerator at which a fan motor 16 is attached. A fan fixing projection 17 extending in the opposite direction of outer casing 4 is formed at inner casing 3. A steal fixing plate 19 to protect plastic inner casing 3 and attached at the inside of fan fixing projection 17 has two holes therein to pass through a bolt 20. The rotating axis side of fan motor 16 is supported by a supporting member 18 via bushings 23. Supporting member 18 is held by bolt 20 passing through the hole of fixing plate 19 and nuts 21 via cushion gum 22. The height of projection 17 is designed to provide enough space so that the tops of bolts 20 do not touch vacuum insulator panel 5. Cooling coil 12 to cool the air in the refrigerator is also attached to inner casing 3 as shown in FIGS. 8 and 9. Each side end of cooling coil 12 has a steal end plate 12*a*. An upper and lower portion of end plate 12*a* is elongated to each side direction. Each bent portion 12*c* has a holes 12*b*. Each coil fixing projection 25, which has a hole 25*a* respectively therein, is extended from inner casing 3 at a position corresponding to a hole 12*b*. Cooling coil 12 is attached by elastic plastic fixing pin 26, which has a hook 26*a* at it's tip, passing through both holes 12*b* and 25*a*. Hook 26*a* passing through hole 25*a* is spread by its own elasticity. After pin 26 is inserted into holes 12*b* and 25*a*, it can not be pulled off. The height of coil fixing projection 25 is also designed to provide enough space that the tip of hook 26*a* dose not touch with vacuum insulator panel 5.

Figure 10:
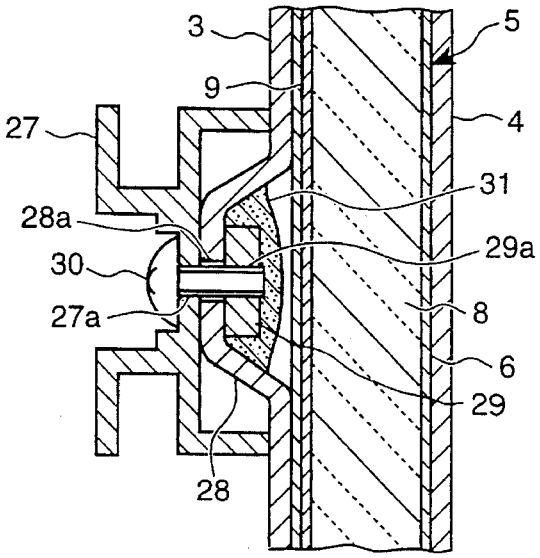
FIG. 10 is an enlarged cross-sectional view of a bracket to support a rack in the refrigerator.

Referring now specifically to FIG. 10, there is shown an enlarged cross-sectional view of a bracket to support a rack of the refrigerator. A shelf rail 27 holds a slide-out shelf in a refrigerator compartment. At this portion, inner casing 3 forms a rail fixing projection 28 extended in the opposite direction of outer casing 4. Shelf rail 27 has a hole 27*a* at it's center. Rail fixing projection 28 also has a hole 28*a*. A plate 29 having a screw nut 29*a* is attached at an inner space of rail fixing projection 28 by an adhesive 31 so than the screw nut 29*a* and hole 28*a* are in line. Rail 27 is arranged so that is's hole 27*a* is in line with hole 28*a* and screw nut 29*a*. A screw 30 is passed through holes 27*a* and 28*a*, and fasted with screw nut 29*a*. In this portion, the height of rail fixing projection 28 is also designed to provide enough space so that the tip of screw 30 does not touch vacuum insulator panel 5. Above described projections 17, 25, and 28 are formed as one body with plastics inner casing 3.

The inside of plane portion of outer shell 1 is filled by vacuum insulator panel 5. Therefore, outer shell 1 has a high insulating performance at the plane portion. All vacuum insulator panels are arranged in the plane portion, so that forces on each vacuum panel are not large. The inside of the corner section, at which there should be a large force, is filled with foamed in place insulator material 11 to increase the strength of outer shell 2.

Package 6 is made of multilayer film. Therefore it can easily be broken when a sharp edge hits it. If package 6 is broken, vacuum insulator panel 5 does not maintain its vacuum and outside air rapidly enters into package 6. If there is no vacuum in a panel 5, it does not insulate properly. Therefore, both inner casing 3 and outer casing 4 have no projections therein. Each space between projections 17, 25 or 28 of inner casing 3 and vacuum insulator panel 5, is kept thick enough to prevent attaching hardware (bolt 20, hook 26*a* and screw 30) from hitting a vacuum insulator panel 5. Soft sheet 9, attached at one side of vacuum insulator panel 5, protects vacuum insulator panel 5 during manufacture, and forces there to be some distance between the inside of outer casing 4 and inner casing 3. Furthermore, soft sheet 9 keeps the foamed in place material 11 from penetrating into the space between inner casing 3 and vacuum insulator panel 5. If the thickness of soft sheet 9 is increased, the insulating performance of casing 1 per thickness is decreased. On the other hand, if soft sheet 9 is very thin, it does not provide proper protection, as described above. Accordingly, the preferred thickness of soft sheet 9 is 1 mm to 5 mm.

Figure 11:
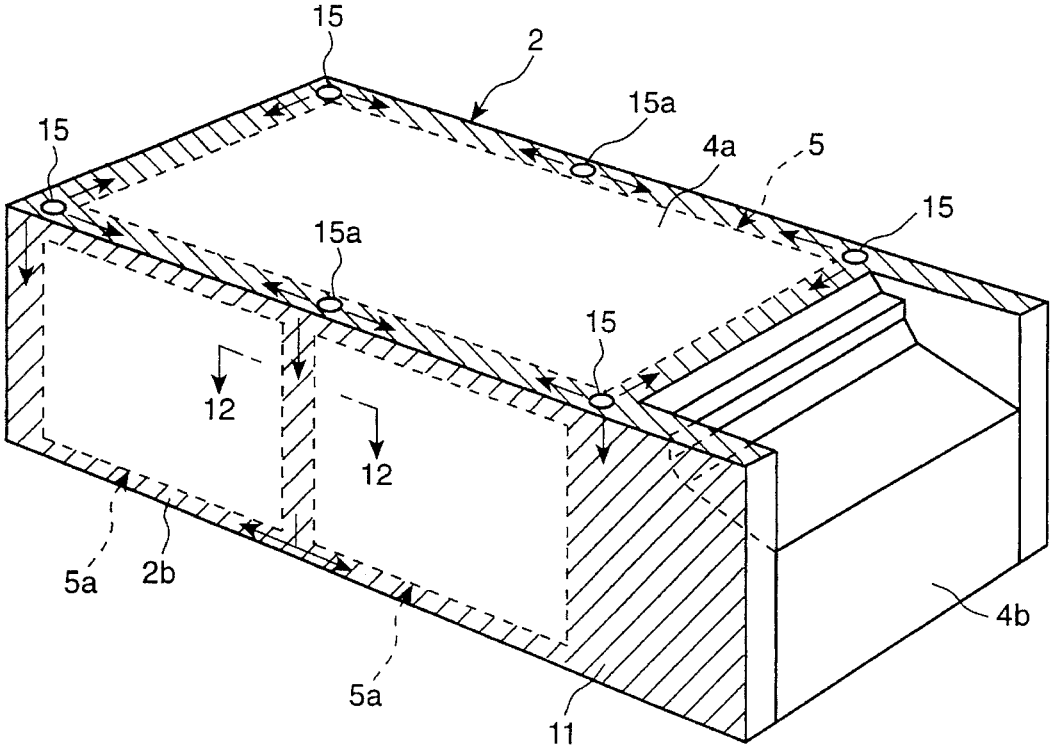
FIG. 11 is a perspective view from the rear of a refrigerator using a two vacuum insulator panels at a planer section according to second embodiment of the present invention.
Figure 12:
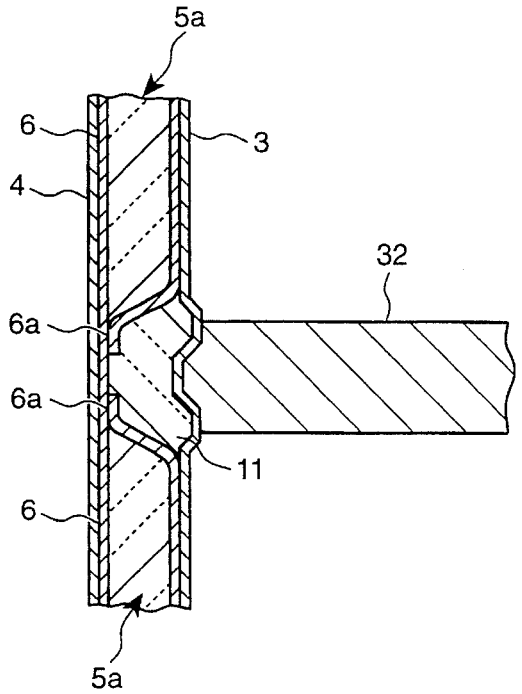
FIG. 12 is a cross-sectional view of a straight joint to join adjacent vacuum insulator panels taken along line 12—12 of FIG. 11.

Referring now FIGS. 11 and 12, there is shown a second embodiment of the invention. In the second embodiment, the side of outer shell 2 contains two separate and distinct vacuum insulator panels 5*a*. Side vacuum insulator panels 5*a* are placed so that there is a space between them. This space is filled with a foamed in place insulator material 11 as shown in FIG. 11. A middle partition 32 (see FIG. 12) is extended at the inside of outer shell 2 from a position between the side vacuum insulator panels 5*a*, as shown in FIG. 12. Additional injection ports 15*a* are located at back board 4*a* corresponding to the space between side vacuum insulators 5*a*. Border 6*a* of side vacuum insulators 5 are attached at the inside of outer casing 4. Therefore, liquid of the foamed in place material 11 injected into ports 15*a* smoothly flows into the space between side vacuum insulator panels 5*a* and front end portion 2*a*.

Figure 13:
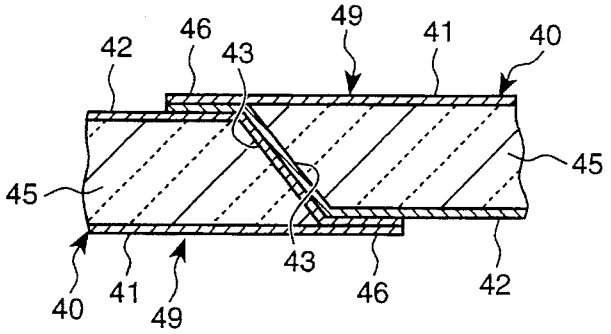
FIG. 13 is a cross-sectional view of another configuration of a straight joint.

Several alternative configurations between adjacent side vacuum insulator panels are shown in FIGS. 13 to 16. In FIG. 13, ends of adjacent side vacuum insulator panels 40 are arranged so as to overlap each other. A package 49 of the vacuum insulator panel 40 is assembled with a formed plastic gas tight cover 42 and a gas tight sheet 41 which seals an opening of cover 42 at the circumference of the cover by hot pressing. The inner space between cover 42 and sheet 41 is filled with insulating filler 45, such as a hard urethane foam and evacuated. The end portion of vacuum insulator panel 40 is formed with a slope 43 from cover 42 down to sheet 41. The circumference of package 49 has a border 46, which is made by hot pressing, extended outwardly from the end portion of vacuum insulator panel 40 and forms a plate with sheet 41. Adjacent vacuum insulator panels 40 are placed upside down, and adjacent slopes 43 are attached to each other an adhesive. Borders 46*a* are attached to cover 42 of the other panel 40. This arrangement has no space between adjacent vacuum insulator panels 40. Therefore, the thermal insulating performance at the connection is not reduced. Furthermore, this construction makes it possible to produce various sizes of insulators by composing small standard size vacuum insulator panels.

Figure 14:
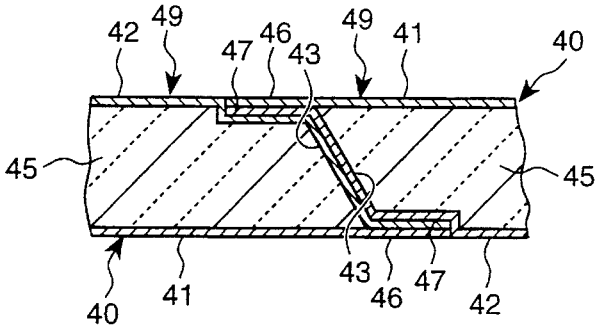
FIG. 14 is a cross-sectional view of another configuration of a straight joint.

FIG. 14 shows another configuration of adjacent vacuum insulator panels 40. The basic configuration of this embodiment is as the same as that shown in FIG. 13. However, in this arrangement, cover 42 has a concave 47 at which border 46 of adjacent vacuum insulator is attached. Concave 47 has the same size as border 46. Thus, border 46 is fit with concave 47, sheet 41 and cover 42 form a flat plane. In this arrangement, accordingly, adjacent vacuum insulator panels 40 formed into a flat panel which is easy to place in outer shell 2.

Figure 15:
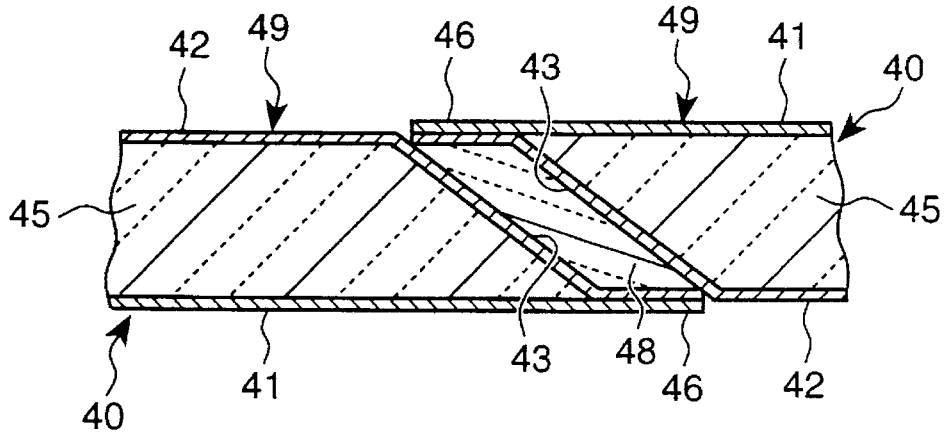
FIG. 15 is a cross-sectional view of another configuration of a straight joint.

Another configuration between adjacent vacuum insulator panels 40 is shown in FIG. 15. Adjacent vacuum insulator panels 40 are placed so as to have a space therebetween. The tip of border 46 touches a corner of cover 42 of adjacent vacuum insulator panel 40. The space surrounded by slopes 43 and borders 46 is filled with a foamed in place insulator material 48 such as foamed urethane. Adjacent vacuum insulator panels 40 are fixed to each other by foamed in place insulator material 48. In this connection, a gentle slope is preferred because it increases the area attached to foamed in place material to make a strong connection.

Figure 16:
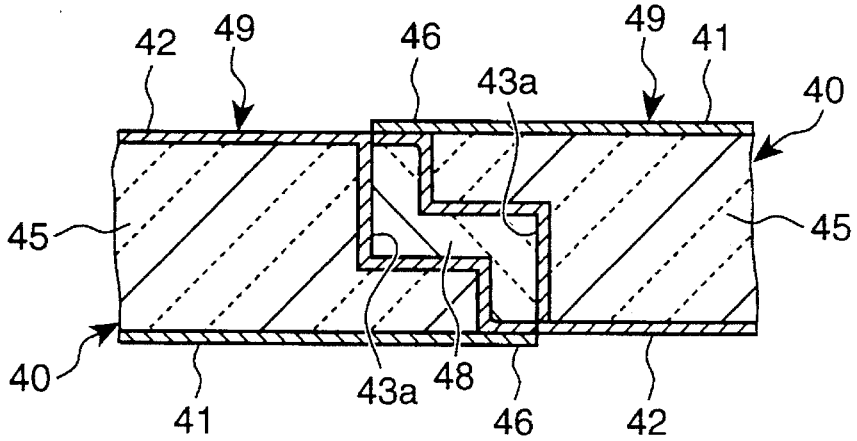
FIG. 16 is a cross-sectional view of another configuration of a straight joint.
Figure 19A:
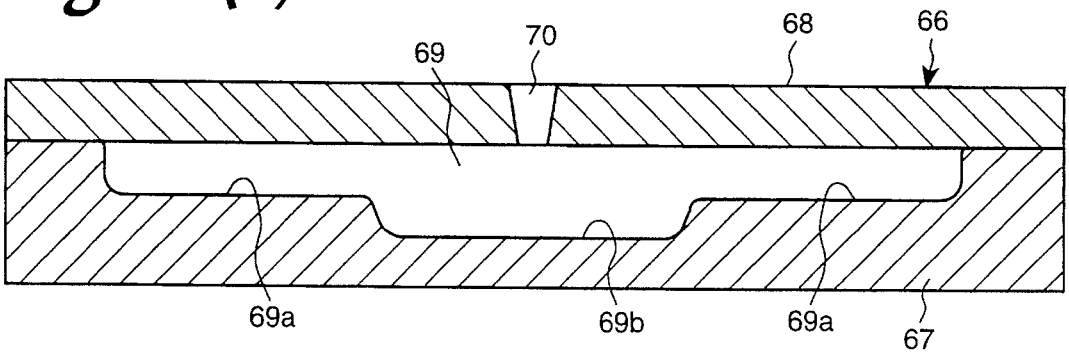
FIGS. 19(*a*) to 19(*d*) show steps for manufacturing a vacuum insulator panel shown in FIG. 18.
Figure 19B:
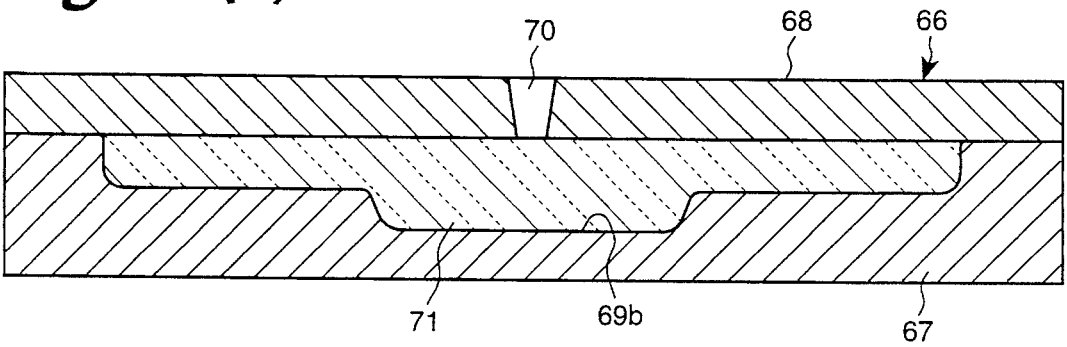
Figure 19C:
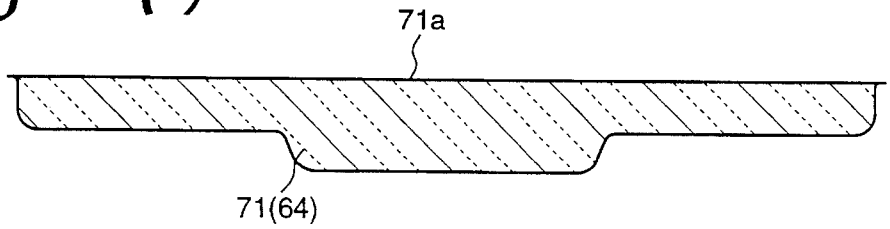
Figure 19D:
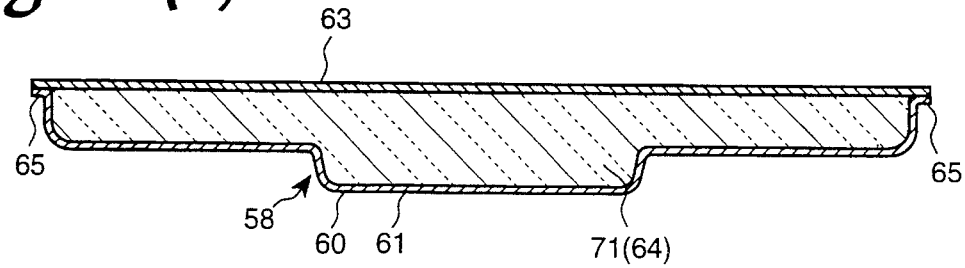

Another connection configuration is shown in FIG. 16. Adjacent vacuum insulator panels 40 have stair step ends 43*a* and are placed so as to have a space between them as in the configuration shown in FIG. 15. The tip of border 46 is touches to a top corner of cover 42 of adjacent vacuum insulator panel 40. Adjacent vacuum insulator panels 40 are placed upside down. The space between them is filled with a foamed in place insulator material 48. Adjacent vacuum insulator panels 40 are fixed to each other by foamed in place insulator material 48.

A third embodiment of the invention is shown in FIGS. 17 to 19. An insulator casing used for a refrigerator casing has a outer shell 51. Outer shell 51 comprises a plastic inner casing 53 and a steel outer casing 54. The interior of outer shell 51 is divided into three compartments, namely, a refrigerating compartment 55, a freezing compartment 56, and a vegetable compartment 57. Inner casing 53 is shaped so that a portion of the inner casing, at a side portion of the freezing compartment 56, extends toward the inside of the refrigerator. At this portion, the distance between outer casing 54 and inner casing 53, or the thickness of the side board is larger than it is at other parts of the refrigerator. This helps to achieve higher insulating performance in the freezing compartment 56. There is a vacuum insulator panel 58 installed in each side board. Vacuum insulator panels 58 fit with the inner casing 53. Accordingly, the middle portion 58*a* of vacuum insulator 59, corresponding to freezing compartment 56, is thicker than other portions 58*b*. A vacuum insulator panel 59 located at the upper roof of outer shell 51 is plane shaped. Each vacuum insulator panel 58, 59 is sandwiched between inner casing 53 and outer casing 54. Space between inner casing 53 and outer casing 54 except the space occupied by a vacuum insulator panel is filled with a foamed in place material (not shown). A package 60 of vacuum insulator panel 58 comprises a gas tight cover 61, which is mainly formed plastics, and a gas tight sheet 63 which attaches and seals an opening of the inner space of cover 61 at the circumference of cover 61 as shown in FIG. 18. The inner space of package 60 is filled with thermal insulating filler 64, such as a hard urethane foam, then, evacuated and maintained at a vacuum. The outer portion of package 60 has a border 65 which extends outwardly from end portion 62 to form into a plane with sheet 63.

Referring now to FIGS. 19(*a*) to 19(*d*), there will be described a method of manufacturing a vacuum insulator panel 58 as used in the above-described third embodiment. A die 66 includes a planer upper cast 68 having a injection port 70 therein at the central portion thereof and a lower cast 67 having a first concave portion 69*a* and a second concave portion 69*b* at a central portion of concave portion 69*a*. When the upper and lower casts are joined, the space therebetween forms a foaming place 69. A mold releasing agent, which makes it easy to remove the formed material from lower cast 67, is applied to the surface of the lower cast. Then, casts 67 and 68 are positioned as shown in FIG. 19(*a*). After that, liquid foam breaker and liquid polyurethane are injected through injection port 70 and pressure is applied to foaming place 69. As a result, continuous foamed polyurethane foam 71 is formed in foaming place 69 as shown in FIG. 19(*b*). During foaming, individual foam in polyurethane is broken by the high pressure and the foam breaker. After foaming, continuous foamed polyurethane foam 71 is removed from die 66. Then, a flat side surface 71*a* of polyurethane foam 71 is shaved as shown in FIG. 19(*c*). As a result of the shaving, the surface of polyurethane foam 71, a so called skin layer, including many individual foams, is peeled and after shaved surface of polyurethane foam 71 appears numerous continuous foam, the number of individual foam on the surface is decreased. After shaving, polyurethane foam 71 is put into an inner space of a gas tight package 60, and air in gas tight package 60 is evacuated through an opening of package 60 (not shown). The surface of polyurethane foam 71 is made flat by the shaving process. Therefore, it is possible to put polyurethane foam 71 into package 60 and evacuate the air therefrom without damaging the package. During evacuating, air in polyurethane foam 71 is draw out passing through continuous foam in polyurethane foam 71. As a result of evacuating, the interior of package 60 including polyurethane foam 71 becomes a vacuum. After evacuating, the opening of package 60 is sealed by any suitable means, e.g., heat sealing or adhesive bonding at border 65 as shown in FIG. 19(*d*).

Figure 20:
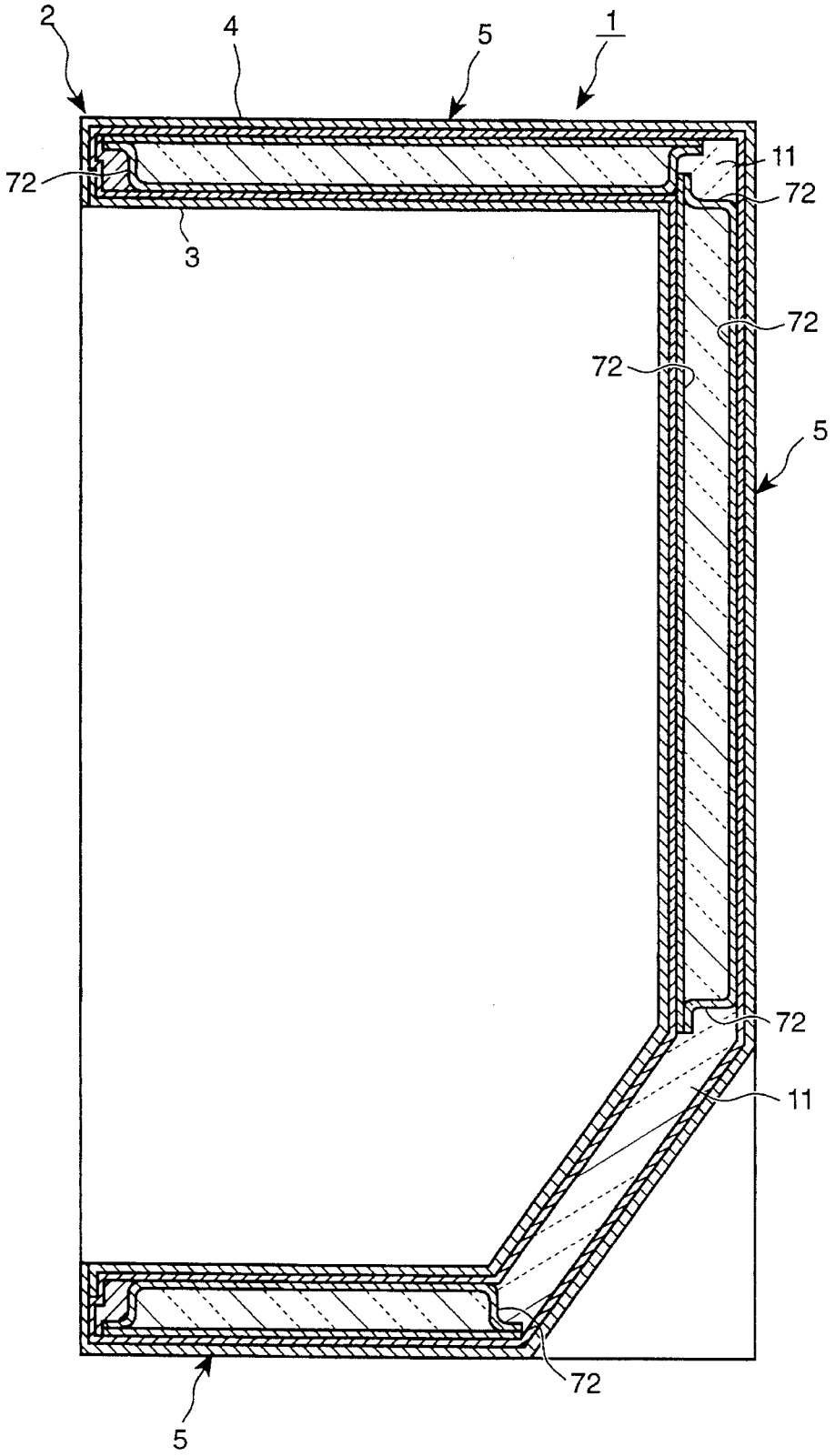
FIG. 20 is a cross-sectional view of a vacuum insulator casing according to a forth embodiment of the present invention.

FIG. 20 shows a forth embodiment according to this invention. Thermal plastics 72, designated by thick lines, are used for the outer surfaces of vacuum insulator panels 5, inner surface of outer casing 4 and outer surface of inner casing 3. One suitable thermal plastic is the etheren-vinyl acetate series thermal plastics adhesive made by Muramatu Sekiyu Kenkyuusyo under the name "ME-125" or made by Cemedain under the name "HM-245". However, other products can be used as well. After applying thermal plastics 72, vacuum insulator panels 5 are sandwiched by outer casing 4 and inner casing 3. Then, liquid foam in place material is injected into the space of outer shell 2. The liquid foam in place material is foamed in the space, so that the space in outer shell 2 is filled with foamed in place material 11. In this embodiment, a vacuum insulator panel 5 is also placed at the bottom of outer shell 2. Consequently, thermal plastics 72 are placed between foamed in place material 11 and inner casing 3, outer casing 4 or vacuum insulator panels 5. Furthermore, thermal plastics 72 are placed between vacuum insulator panel 5 and inner casing 3 or outer casing 4. In normal temperature conditions, inner casing 3, outer casing 4, foamed in place material 11 and vacuum insulator panels 5 are firmly fixed to each other by thermal plastics 72. When casing 1 is separated in order to dispose of it, the casing is heated to a predetermined temperature, which is lower than the decomposition temperature of the material in casing 1 except for that of the thermal plastics 72, for example 100° C. Thus, only thermal plastics 72 in casing 1 melts. Thus the various components, i.e. inner casing 3, outer casing 4, foamed in place material 11 and vacuum insulator plate 5, are easy to separate. If it is necessary to separate only particular components from the vacuum insulator casing, thermal plastics may be applied to the surface of the particular components to be later separated. Another thermal plastic, for example polyvinylidene chloride film or hot melting material polyethylene e.g., can be used. Of course, it is necessary to use a material having a melting temperature that is lower than the decomposition temperature of the other components used in the construction of the vacuum insulator casing, and higher than the temperature at which the vacuum insulator casing will be used.

Many changes and modifications the above described embodiment can be carried out without departing from the scope of general inventive concept as defined by the appended claims and their equivalents.

What is claimed is:

1. A vacuum insulator casing for thermal insulating comprising:

an inner casing including:
at least two planer sections, and
a corner section located between the planer sections;

an outer casing having a shape substantially the same as that of the inner casing, but which is larger, which covers the inner casing so as to form a space therebetween;

a plurality of vacuum insulator panels each having first and second sides, each panel having:
a gas tight outer package from which air has been evacuated, and
a low thermal conductivity material filled in the package, each vacuum insulator panel being sandwiched between the outer casing and the inner casing so that one side of each panel touches the outer casing and one side of each panel touches the inner casing;

a filling insulator material filling any remaining space not occupied by the vacuum insulator panels between the outer and inner casings, wherein the outer casing has an injection port therein located at the corner section thereof for injecting the insulator into the casing, and wherein the insulator is a foamed in place plastic material which is foamed inside of the casing after injection.

2. A vacuum insulator casing according to claim 1, wherein the inner casing has a projection portion extended in the opposite direction of the outer casing for attaching an auxiliary device.

3. A vacuum insulator casing according to claim 1, wherein the first side of each vacuum insulator panels has a extended end portion, which extends straight and outwardly more than the second side, and wherein the end of each vacuum insulator panel is formed with a taper, and the vacuum insulator panels are arranged so as to form a space between the tapers of adjacent vacuum insulator panels, the space being filled with the filling insulator material.

4. A vacuum insulator casing according to claim 1, further including a thermal plastics layer between the inner casing and the vacuum insulator panel.

5. A vacuum insulator casing according to claim 1, further including a thermal plastics layer between the outer casing and the vacuum insulator panel.

6. A vacuum insulator casing according to claim 1, further including a first thermal plastics layer between the inner casing and the vacuum insulator, and a second thermal plastics layer between the outer casing and the vacuum insulator panel.

7. A vacuum insulator casing according to claim 1, further including a thermal plastics layer between the filling insulator material and the vacuum insulator panel.

8. A vacuum insulator casing for thermal insulating comprising:

an inner casing including:
at least two planer sections, and
a corner section located between the planer sections;

an outer casing having a shape substantially the same as that of the inner casing, but which is larger, which covers the inner casing so as to form a space therebetween;

a plurality of vacuum insulator panels each having first and second sides, each panel having:
a gas tight outer package from which air has been evacuated, and
a low thermal conductivity material filled in the package, each vacuum insulator panel being sandwiched between the outer casing and the inner casing so that one side of each panel touches the outer casing and one side of each panel touches the inner casing;

a filling insulator material filling any remaining space not occupied by the vacuum insulator panels between the outer and inner casings, wherein an end of each vacuum insulator panel has a portion extending outwardly and formed into a portion that is planer with the first side of the vacuum insulator panel, and wherein the vacuum insulator panels are arranged so that the extended portion of one vacuum insulator panel is attached to a corresponding second side of an adjacent vacuum insulator panel at the corner section thereof.

9. A vacuum insulator casing according to claim 8, wherein the outer casing has an injection port therein located at the corner section thereof for injecting the insulator into the casing, and wherein the insulator is a foamed in place plastic material which is foamed inside of the casing after injection.

10. A vacuum insulator casing for thermal insulating comprising:

an inner casing including:
at least two planer sections, and
a corner section located between the planer sections;

an outer casing having a shape substantially the same as that of the inner casing, but which is larger, which covers the inner casing so as to form a space therebetween;

a plurality of vacuum insulator panels each having first and second sides, each panel having:

a gas tight outer package from which air has been evacuated, and a low thermal conductivity material filled in the package, each vacuum insulator panel being sandwiched between the outer casing and the inner casing so that one side of each panel touches the outer casing and one side of each panel touches the inner casing;

a filling insulator material filling any remaining space not occupied by the vacuum insulator panels between the outer and inner casings, wherein the first side of an end of each vacuum insulator panel has a portion extend straight and outwardly more than that of the second side thereof, and wherein the vacuum insulator panels are arranged so that the extend portion of one vacuum insulator panel is attached at the second side of the adjacent vacuum insulator panel and the end of the vacuum insulator panel is attached at the end of the adjacent vacuum insulator panel at the straight section of the casing.

11. A vacuum insulator casing according to claim 10, wherein the second side of the vacuum insulator panel has a concave portion at an overlap portion at which the extended portion of the adjacent vacuum panel attaches so as to form therewith a substantially planer overlap portion.

12. A vacuum insulator casing for thermal insulating comprising:

an inner casing including:

at least two planer sections, and a corner section located between the planer sections;

an outer casing having a shape substantially the same as that of the inner casing, but which is larger, which covers the inner casing so as to form a space therebetween;

a plurality of vacuum insulator panels each having first and second sides, each panel having:

a gas tight outer package from which air has been evacuated, and a low thermal conductivity material filled in the package, each vacuum insulator panel being sandwiched between the outer casing and the inner casing so that one side of each panel touches the outer casing and one side of each panel touches the inner casing;

a filling insulator material filling any remaining space not occupied by the vacuum insulator panels between the outer and inner casings, wherein the first side of each vacuum insulator panel has an extend end portion, which extends straight and outwardly more than the second side, and wherein the end of each vacuum insulator panel is formed with a stair step configuration, and the vacuum insulator panels are arranged so as to form a space between the stair step configuration portions of adjacent vacuum insulator panels, the space being filled with the filling insulator material.

* * * * *